US008087373B2

(12) United States Patent
Mattson

(10) Patent No.: US 8,087,373 B2
(45) Date of Patent: Jan. 3, 2012

(54) INTERCONNECTION SYSTEM FOR FLOATING MODULES

(76) Inventor: Jerry L. Mattson, Lake Ozark, MO (US)

( * ) Notice: Subject to any disclaimer, the term of this patent is extended or adjusted under 35 U.S.C. 154(b) by 112 days.

(21) Appl. No.: 12/437,982

(22) Filed: May 8, 2009

(65) Prior Publication Data

US 2010/0282155 A1 Nov. 11, 2010

(51) Int. Cl.
*B63B 35/44* (2006.01)
*E02B 3/00* (2006.01)

(52) U.S. Cl. ..... 114/267; 114/263; 114/264; 114/265; 114/266

(58) Field of Classification Search ..... 114/263–267
See application file for complete search history.

(56) References Cited

U.S. PATENT DOCUMENTS

| | | | | |
|---|---|---|---|---|
| 3,091,203 | A | 5/1963 | Usab | |
| 3,128,737 | A | 4/1964 | Thompson | |
| 3,221,696 | A | 12/1965 | Gardner | |
| 3,546,773 | A | 12/1970 | Gerstin | |
| 3,799,093 | A | 3/1974 | Thompson | |
| 3,977,344 | A | 8/1976 | Holford | |
| 4,265,193 | A | 5/1981 | Sluys | |
| 4,318,361 | A | 3/1982 | Sluys | |
| 4,318,362 | A | 3/1982 | Jung | |
| 4,321,882 | A | 3/1982 | Sluys | |
| 4,365,914 | A | 12/1982 | Sluys | |
| 4,406,564 | A | 9/1983 | Hanson | |
| 4,487,151 | A | 12/1984 | Deiana | |
| RE31,984 | E | 9/1985 | Sluys | |
| 4,693,631 | A | 9/1987 | McKay | |
| 4,697,539 | A | 10/1987 | Creed | |
| 4,709,647 | A | 12/1987 | Rytand | |
| 4,715,307 | A | 12/1987 | Thompson | |
| 4,733,626 | A | 3/1988 | Svirklys et al. | |
| 4,799,445 | A * | 1/1989 | Meriwether | 114/267 |
| 4,852,509 | A | 8/1989 | Fransen et al. | |
| 4,887,654 | A | 12/1989 | Rytand | |
| 4,930,184 | A | 6/1990 | Kristmanson | |
| 4,940,021 | A | 7/1990 | Rytand | |
| 4,947,780 | A | 8/1990 | Finn | |
| 5,044,296 | A | 9/1991 | Finn | |
| 5,050,524 | A | 9/1991 | Kyhl et al. | |
| 5,107,785 | A | 4/1992 | Baxter | |
| 5,129,347 | A | 7/1992 | Hill | |
| 5,215,027 | A | 6/1993 | Baxter | |
| 6,199,502 | B1 | 3/2001 | Mattson | |
| 6,205,945 | B1 * | 3/2001 | Passen et al. | 114/267 |
| 7,640,881 | B1 * | 1/2010 | Gerst et al. | 114/263 |

* cited by examiner

*Primary Examiner* — Daniel Venne
(74) *Attorney, Agent, or Firm* — Erickson, Kernell, Derusseau & Kleypas, LLC

(57) ABSTRACT

A floating module and fastening system for interconnecting a row of modules while allowing relative movement of the modules resulting from wave action. The present invention provides a system for interconnecting floating structures to form breakwaters and other integrated floating structures. The interconnection system includes one or more cables or other securing lines extending longitudinally through a row of floating structures and fastened at the ends of the row. Two or more socket members, through which the cables pass, are secured in and project outwardly from each end wall of the floating structures. Each of the socket members defines a recess, which extends into the end walls of the floating structures. Opposed socket members projecting from adjacent floating structures are sized so that an end of a first of the socket members fits within an opposed end of a second of the socket members. A resilient member or cushion having a shape generally corresponding to the shape of the recesses in the opposed socket members may be received within adjacent recesses of overlapping first and second socket members.

9 Claims, 3 Drawing Sheets

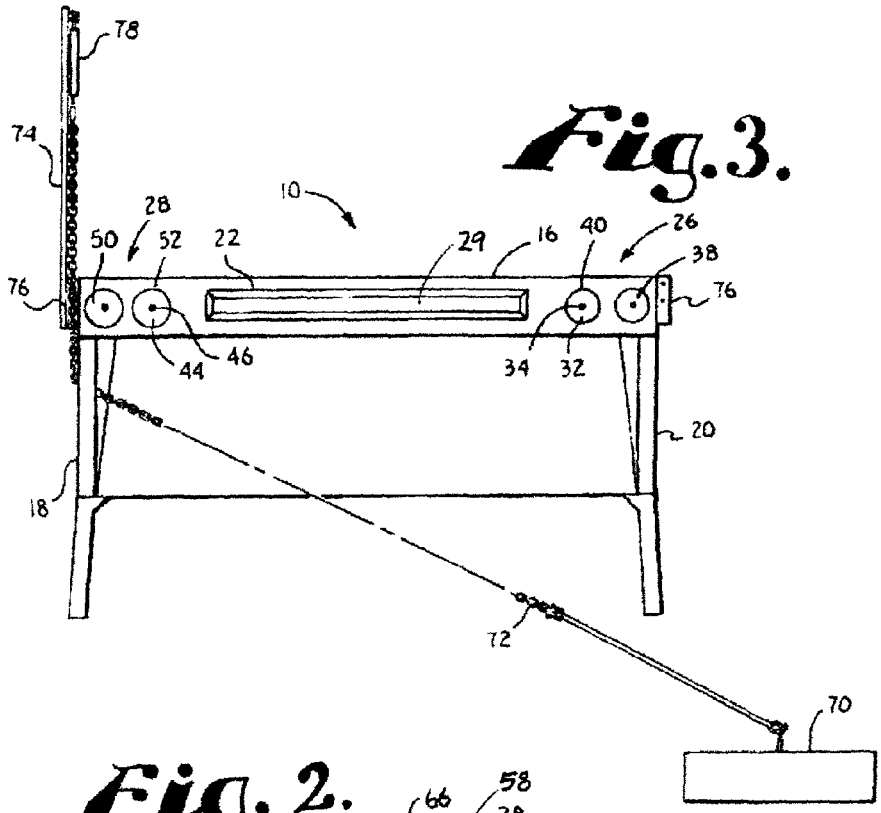
Fig. 3.
Fig. 2.
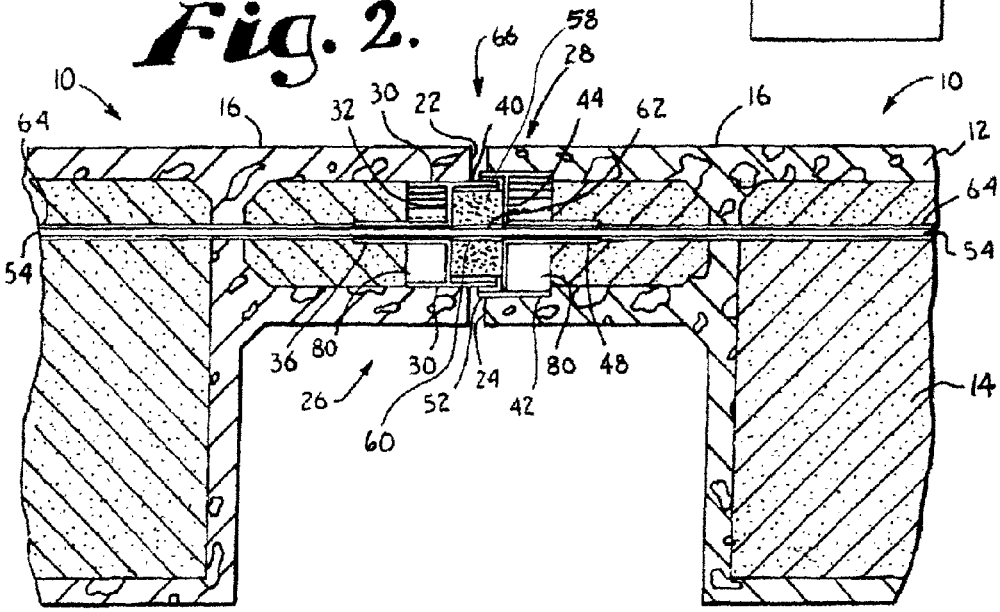

INTERCONNECTION SYSTEM FOR FLOATING MODULES

FIELD

The present invention relates to floating structures for docks and breakwaters, and more particularly, to floating modules and a system for interconnecting floating modules to form docks and breakwaters.

BACKGROUND

Floating structures such as docks, decks, wharfs, breakwaters, walkways, boat slips and other structures are known in the art. These floating structures are typically interconnected using tie rods and side wales extending along the sides of the floating structures and fastened together. Other structures use hinges to connect the ends of adjacent floating structures. Still other structures use cables and rods which pass through the floating structures lengthwise and use rubber pads or resilient members between the structures for a cushion.

Some of these floating structures, while acceptable for relatively small interconnected structures, are not suitable for applications encountering rougher waters. Many of these systems do not allow sufficient pivoting motion between interconnected floats when fairly large waves are encountered. As a result, the interconnection system often fails. Other of these systems are not sufficiently strong to endure the pivotal motion over an extended period, or when encountering large storms. The resilient members of some of these structures are exposed to high shear forces. Additionally, the resilient members degrade over time due to exposure to sunlight.

SUMMARY

The present invention provides a system for interconnecting floating structures to form breakwaters and other integrated floating structures. The interconnection system includes one or more cables or other securing lines extending longitudinally through a row of floating structures and fastened at the ends of the row. Two or more socket members, through which the cables pass, are secured in and project outwardly from each end wall of the floating structures. Each of the socket members defines a recess, which extends into the end walls of the floating structures. Opposed socket members projecting from adjacent floating structures are sized so that an end of a first of the socket members fits within an opposed end of a second of the socket members. A resilient member or cushion having a shape generally corresponding to the shape of the recesses in the opposed socket members may be received within adjacent recesses of overlapping first and second socket members.

The resilient members include a longitudinally extending bore through which the cables pass. The socket members extending from adjacent end walls interfit or overlap to encase the resilient members and provide protection from exposure to sunlight. The overlapping socket members further protect the resilient members from excessive twisting, bending and shear forces at the connection.

Fingers or slips may be formed by securing one or more modules perpendicularly to a main structure of modules with cables extending longitudinally through the slip structures and laterally through the main structure.

BRIEF DESCRIPTION OF THE DRAWINGS

FIG. 2 is a partial sectional view of the interconnection between two floating modules.

FIG. 3 is an end view of a floating module.

DETAILED DESCRIPTION

Figure 4:
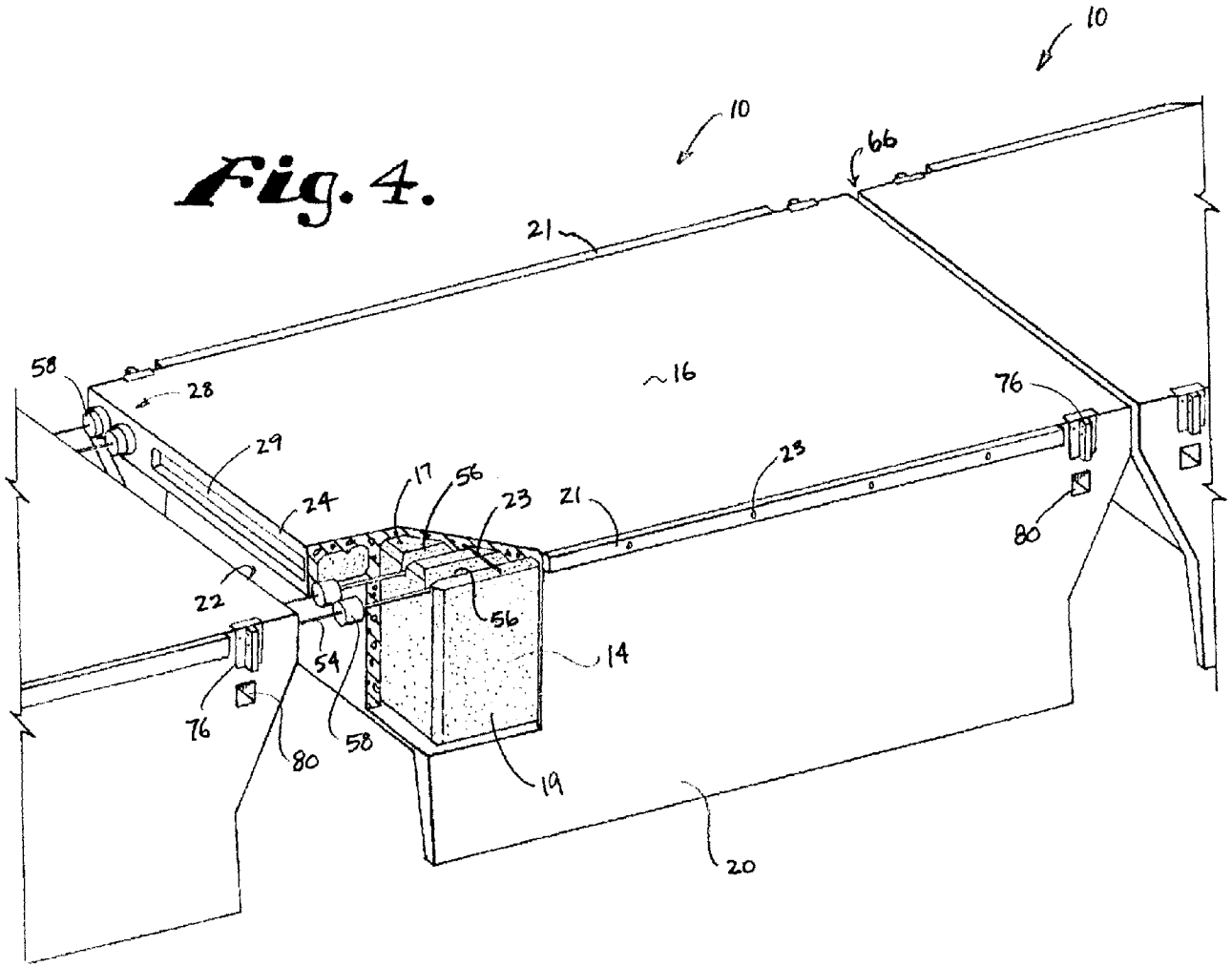
FIG. 4 is a perspective sectional and exploded view of the interconnection between two floating modules.

Referring to the figures, an interconnecting system for flexibly securing together one or more floating structures or modules 10 is disclosed. The modules 10 may conventionally include a rigid shell 12 formed from concrete or other moldable cementitious materials including polymer plastics surrounding and encasing a buoyant core 14 such as a foam core for example. The modules 10 include a rectangular top 16, sides 18 and 20, and end walls 22 and 24. The end walls 22 and 24 each include two or more male and female interconnecting assemblies or socket members 26 and 28 respectively, and a utility recess 29. As shown in FIG. 4, the interconnecting assemblies 26 and 28 are used to connect the modules 10 in an end to end alignment to form a floating structure. However, it is to be understood that the interconnecting assemblies could be used to connect one module 10 perpendicularly to another module to form boat slips or fingers.

The buoyant core 14 may include grooves running laterally across the top surface 17 and vertically along the side surfaces 19 to provide additional structural strength to the module 10 when encased in concrete or other material. Two sets of two longitudinal grooves 56, are formed in the top surface 17 of the foam core 14 running parallel to and proximate to the sides 19 of the foam core 14. A cable receiving conduit 64 is positioned within the trough of each longitudinal groove 56. The conduits 64 are sized shorter than the foam core, such that the ends of each conduit 64 are recessed in the foam core 14. Side wales 21 with conduits 23 extending through the side wales 21 also allow two or more modules 10 to be connected in a perpendicular configuration, as discussed in more detail hereafter, to form fingers or boat slips, for example.

Figure 1:
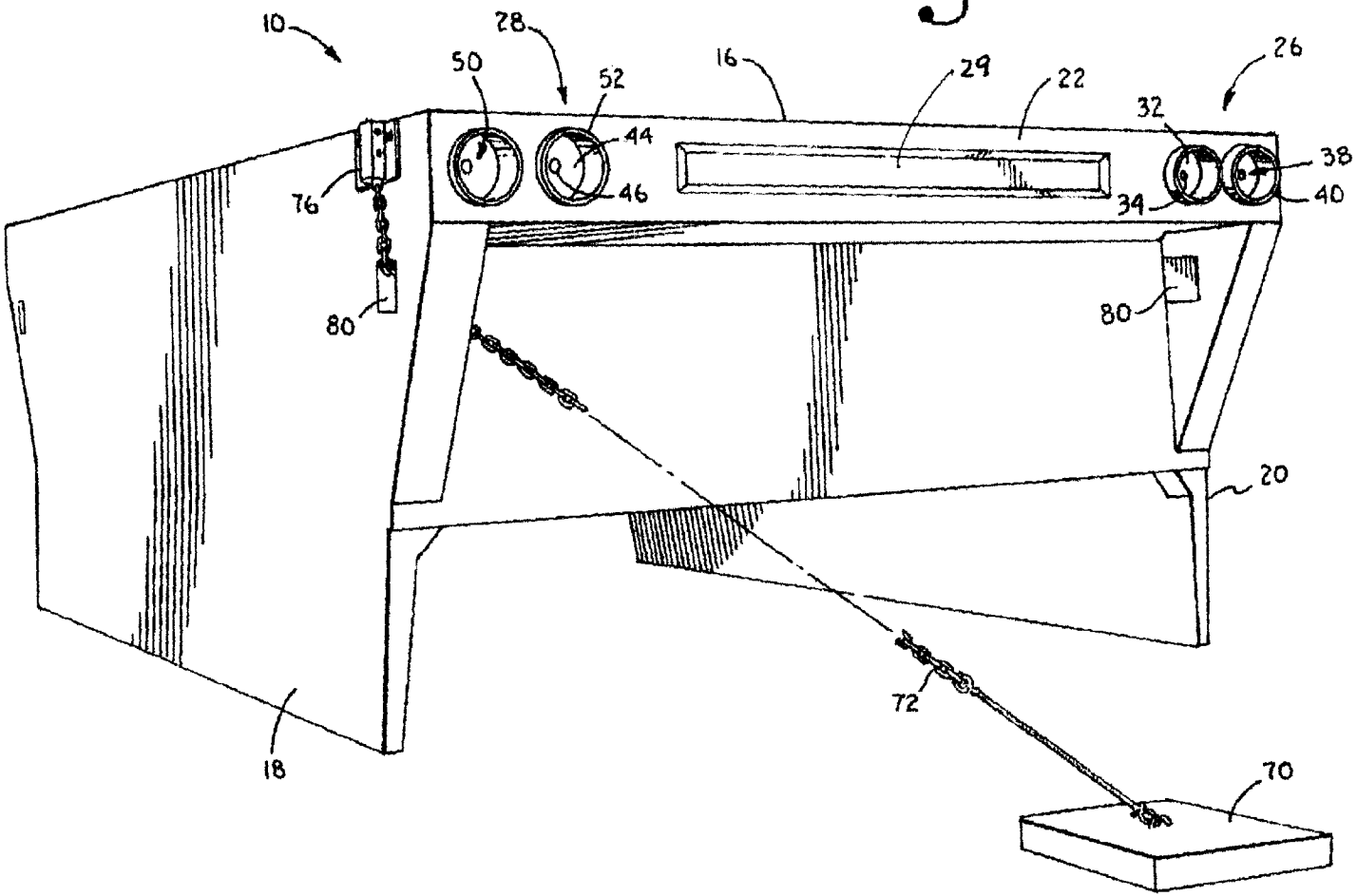
FIG. 1 is a perspective end view of a floating module.

As best seen in FIGS. 1 and 2, the male interconnecting assembly 26 includes a cylindrical side wall 30, a base plate 32 with an aperture 34 formed centrally therein, and a base tube or sleeve 36 axially aligned with the aperture 34. The male interconnecting assembly 26 may be embedded in the end wall 22 with the base tube 36 extending inwardly to the end wall 22 recess or socket 38. The depth that the socket 38 extends into the surface of end wall 22 may be approximately one to four inches, and preferably one and one-half inches. The depth of the socket 38 is the distance from the surface plane of the end wall 22 to the base plate 32. The side wall 30 of male interconnecting assembly 26 extends outwardly from the end wall 22 to present a collar 40. The height of the collar 40 extending from the end wall 22 may be approximately three-quarters to one and one-half inches, and preferably one and one-quarter inches. The height of the collar 40 is the distance from the surface plane of the end wall 22 to the exposed free end of the cylindrical side wall 30 extending from the end wall 22. The cylindrical side wall 30 has a length of approximately five to twelve inches, and preferably six inches. The cylindrical side wall 30 has a diameter of approximately six to ten inches, and preferably eight and five-eighths inches.

The base tube 36 may be welded or otherwise secured or attached to the base plate 32. The base plate 32 may be welded or otherwise secured to the cylindrical side wall 30. The base tube 36 may be approximately four to twelve inches long, and preferably six inches long with a diameter of approximately one to two inches, and preferably one and one-half inches. The aperture 34 may be sized to match the base tube 36 diameter.

The female interconnecting assembly 28 may be similar in construction to the male interconnecting member 26 but slightly larger in diameter. The female interconnecting member includes a cylindrical side wall 42, a base plate 44 with an aperture 46 formed centrally therein, and a base tube or sleeve 48 axially aligned with the aperture 46. The female interconnecting assembly 28 may be embedded in the end wall 24 with the base tube 48 extending inwardly to the end wall 24. The base plate 44 and cylindrical side wall 42 combine to form a recess or socket 50 with a depth and diameter. The depth of the socket 50 may be approximately one to four inches, and preferably one and one-half inches. The side wall 42 of female interconnecting assembly 28 extends outwardly from the end wall 24 to present a collar 52. The height of the collar 52 extending from the end wall 24 is approximately one-quarter to one and one-half inches, and preferably three-quarters of an inch. The height of the collar 52 is the distance from the surface plane of the end wall 24 to the exposed free end of the cylindrical side wall 42 extending from the end wall 24. The cylindrical side wall 42 has a length of approximately five to twelve inches, and preferably six inches. The cylindrical side wall 42 has a diameter of approximately six to twelve inches, and preferably ten inches.

The base tube 48 may be welded or otherwise secured or attached to the base plate 44. The base plate 44 may be welded or otherwise fastened to the side wall 42. The base tube 48 may be approximately four to twelve inches long, and preferably six inches long with a diameter of approximately one to two inches, and preferably one and one-half inches. The aperture 46 may be sized to match the base tube diameter 48.

Each module 10 may be formed in a mould not shown. One of the cable receiving conduits 64 may be inserted in each of the four longitudinal grooves 56 in the foam core 14. In a preferred embodiment, two male interconnecting members 26 may be positioned on one end toward one of the corners of the foam core 14 with a distal end of an associated base tube 36 abutting against or receiving an end of one of the cable receiving conduits 64. The base tube 36 may be preferably welded to the conduit 64 with the internal apertures aligned. Two additional male interconnecting members 26 are positioned on the other end toward the opposite diagonal corner of the foam core 14.

Two female interconnecting members 28 may be positioned at each end of the foam core 14 at opposite corners from the male interconnecting members 26. A distal end of the associated base tube 48 may be abutting against or receiving an opposite end of one of the cable receiving conduits 64. The base tubes 48 are preferably welded to the conduit 64 with the internal apertures aligned. With the conduits 64 and base tubes 48 and 36 aligned and secured together, a tube passes longitudinally through the module 10 from one end 22 to the other end 24.

Before positioning the side wales 21 along the sides of the foam core 14, the side wales 21 on opposite sides 18 and 20 of the module 10 are first connected together by extending a plurality of conduits 23 through aligned bores in the side wales 21 so that the conduits 23 extend transverse to the side wales 21 to form a side rail assembly 25. The side rail assembly 25 may then be set on top of the foam core 14 with the conduits 23 resting on an upper surface of the foam core 14 and the side wales extending along the sides 19 of the foam core 14. Concrete or other plastic material may then poured into the mould around the foam core 14, the cable receiving conduits 64, the side rail assembly 25, and the male and female interconnecting assemblies 26 and 28, and allowed to set. The utility recesses 29 are formed in each end wall 22 and 24 of the module 10 by the mould.

In the modules 10 formed in this manner, end wall 22 has two male interconnecting assemblies 26 and two transversely-spaced female interconnecting assemblies 28 projecting therefrom. The opposite end wall 24 has two female interconnecting assemblies 28 and two transversely-spaced male interconnecting assemblies 26 extending therefrom. The modules 10 could be formed in alternative configurations with fewer or more interconnecting assemblies 26 or 28 formed in and extending from each end wall 22 and 24. It is to be understood that the type of interconnecting assembly 26 or 28 projecting from each end wall 22 and 24 can be varied. For example, with four interconnecting assemblies per end, four male interconnecting assemblies 26 may be extending from one end wall and four female interconnecting assemblies 28 may be extending from the other end wall. Other variations may be utilized. However, the interconnecting assemblies 26 and 28 directly opposite each other on abutting modules 10 are of the opposite type, i.e. for each male interconnecting assembly 26, the axially aligned interconnecting assembly on the other end of the module 10 is a female interconnecting assembly 26.

Two or more modules 10 may be abutted and connected together by threading cables 54 through the conduits 64 of one module through aligned sets of male and female interconnecting assemblies 26 and 28 and resilient members 58, and through the conduits 64 of the abutting module. The resilient member 58 is sized and shaped to be received in overlapping interconnecting assemblies 26 and 28 as described hereafter.

Each resilient member 58 is preferably cylindrically-shaped conforming to the cylindrical shape of the male interconnecting assembly 26 socket 38 and the female interconnecting assembly 28 socket 50, although shapes other than a cylinder may be utilized. The resilient member 58 has a length of two to twelve inches, preferably four to six inches, and a diameter of four to ten inches, preferably six to eight inches. Each resilient member 58 includes an axially-extending cylindrical bore 60 through which the cable 54 passes. A rigid tube 62 lines the bore 60 to prevent the cable from damaging the resilient member 58. The length of the tube 62 may be less than the length of the resilient member 58 to allow for compression of the resilient member 58 when the modules 10 are assembled and during use.

When abutting modules 10 are longitudinally aligned, male interconnecting assemblies 26 and female interconnecting assemblies 28 are opposed and longitudinally aligned. The collars 40 of the male interconnecting assemblies 26 extend from end walls 22 and 24 and nest within the collars 52 of the female interconnecting assemblies 28 which extend from end walls 22 and 24 opposite collars 40. Cables 54 are threaded through the longitudinal conduits 64 starting at a free end of the first module 10 and out the abutting end. The cable 54 passes out the associated interconnecting assembly through the resilient member 58 and into the aligned abutting interconnecting assembly. The cable 54 passes through the longitudinal conduit 64 of the abutting second module 10 and out the opposite free end. When the cables 54 are tightened to a predetermined tension the resilient members 58 are compressed between the base plates 32 and 44 of the male and female interconnecting assemblies 26 and 28. In addition, the collars 40 and 52 of opposed abutting interconnecting assemblies 26 and 28 preferably overlap at least one half inch or more, i.e., because height of collar 40 is greater than the height of collar 52, and the diameter of collar 40 is less than the diameter of collar 52, collar 40 fits within collar 52 extending one-half inch or more into collar 52. A transverse gap 66 formed between abutting modules 10 has a width of approximately one-half to two inches. In order for the overlapping collars 40 and 52 to shield the resilient members 58 from direct exposure to the environment, the length of resilient member 58 is between the combined depth of the sockets 38 and 50 and the combined depth of the sockets 38 and 50 and the height of the collars 40 and 52. In other words, the resilient member 58 has to be long enough to space abutting modules 10 apart so that the abutting end walls 24 and 28 do not touch when stationary and when in motion (encountering waves). The resilient member 58 should be short enough so that when abutting male and female interconnecting assemblies 26 and 28 are positioned together, the corresponding collar 52 of the female interconnecting assembly 28 overlaps the collar 40 of the male interconnecting assembly 26.

The rigid tube 62 embedded in each resilient member 58, in combination with the nesting collars 40 and 52 limit the shear, bending and twisting forces, and stresses exerted on the resilient member 58. For normal loads, the resilient members 58 have sufficient shear strength to prevent excessive horizontal and vertical transverse and longitudinal movement of one module 10 with respect to an adjacent abutting module 10. However, if the modules 10 encounter excessive forces, (i.e., large waves caused by a storm or a passing boat), the nesting collars 40 and 52 limit the forces transferred to the resilient members 58. Additionally, the collars 40 and 52 shield the resilient members 58 from sunlight to prevent degradation from exposure.

When two or more modules 10 are joined together to form a breakwater or other structure, the structure may be secured to one or more concrete blocks 70 or other suitable anchors, with a chain or cable 72. Referring to FIGS. 3 and 4, a temporary post 74 may be attached to a bracket 76 which may be secured to either of the sides 18 or 20 of the module 10. The anchor chain 72 may be attached to a come-along 78 mounted to the post 74 and extended through an aperture 80 in the side 18 or 20 of module 10 to the anchor 70 to secure the modules 10 in position. Once the modules are positioned in a desired location, the chain 72 may be bolted or otherwise fastened to the bracket 76 and the come-along 78, post 74, and excess chain 72 may be removed.

It is to be understood that while certain forms of this invention have been illustrated and described, it is not limited thereto, except in so far as such limitations are included in the following claims and allowable equivalents thereof. As used herein the phrase overlapping relationship of two members or other structure is intended to encompass either member or structure overlapping the other. In addition, the term wall or member is not limit to planar, solid structures, but rather is generally intended to encompass structure which separates one region or area from another and may include structures with openings therein such as meshes or grates or the like.

Having thus described the invention, what is claimed as new and desired to be secured by Letters Patent is:

1. A floating module comprising:

a shell encasing a buoyant foam core having a top, a first side opposite a second side, a first end wall opposite a second end wall and a bottom, first and second male interconnecting assemblies each having a cylindrical side wall having a diameter, a base plate secured inside said cylindrical side wall and generally perpendicular to said cylindrical side wall, and an aperture through said base plate at approximately a center of said base plate, said first male interconnecting assembly having a first male end embedded in said first end wall proximal said first side and having a first male collar extending from said first end wall opposite said first male end, said first male collar having a height, said second male interconnecting assembly having a second male end embedded in said second end wall proximal said second side and having a second male collar extending from said second end wall opposite said second male end, said second male collar having a height, first and second female interconnecting assemblies each having a cylindrical side wall having a diameter, a base plate secured inside said cylindrical side wall and generally perpendicular to said cylindrical side wall, and an aperture through said base plate at approximately a center of said base plate, said first female interconnecting assembly having a first female end embedded in said first end wall proximal said second side and longitudinally aligned with said second male interconnecting assembly and having a first female collar extending from said first end wall opposite said first female end, said first female collar having a height, said second female interconnecting assembly having a second female end embedded in said second end wall proximal said first side and longitudinally aligned with said first male interconnecting assembly and having a second female collar extending from said second end wall opposite said second female end, said second female collar having a height, a first conduit extending longitudinally through said shell and connecting said aperture of said base plate of said first male interconnecting assembly with said aperture of said base plate of said second female interconnecting assembly, a second conduit extending longitudinally through said shell and connecting said aperture of said base plate of said first female interconnecting assembly with said aperture of said base plate of said second male interconnecting assembly, wherein said first male collar height is greater than said second female collar height, wherein said second male collar height is greater than said first female collar height, wherein said diameter of said cylindrical side wall of said first male interconnecting assembly is less than said diameter of said cylindrical side wall of said second female interconnecting assembly, and wherein said diameter of said cylindrical side wall of said second male interconnecting assembly is less than said diameter of said cylindrical side wall of said first female interconnecting assembly.

2. The floating module of claim 1 wherein said base plate of said first male interconnecting assembly is secured to said inside of said cylindrical side wall of said first male interconnecting assembly at a depth equal to or greater than said height of said first male collar to present a first male socket having a depth, wherein said base plate of said second male interconnecting assembly is secured to said inside of said cylindrical side wall of said second male interconnecting assembly at a depth equal or greater than said height of said second male collar to present a second male socket wherein said base plate of said first female interconnecting assembly is secured to said inside of said cylindrical side wall of said first female interconnecting assembly at a depth equal to or greater than said height of said first female collar to present a first female socket having a depth, and wherein said base plate of said second female interconnecting assembly is secured to said inside of said cylindrical side wall of said second female interconnecting assembly at a depth equal or greater than said height of said second female collar to present a second female socket.

3. The floating module of claim 2 further comprising:

a first cylindrical resilient member having a diameter, a length and an axially-aligned bore, said diameter of said first cylindrical resilient member being smaller than said diameter of said diameter of said cylindrical side wall of said first male interconnecting assembly, and a second cylindrical resilient member having a diameter, a length and an axially-aligned bore, said diameter of said second cylindrical resilient member being smaller than said diameter of said cylindrical side wall of said second male interconnecting assembly.

4. The floating module of claim 3 wherein said length of said first resilient member is greater than the combined depth of said first male socket and said depth of said second female socket, wherein said length of said first resilient member is less than the combined depth of said first male socket and said depth second female socket, and the combined height of said first male collar and second female collar, wherein said length of said second resilient member is greater than the combined depth of said first female socket and said depth of said second male socket, and wherein said length of said first resilient member is less than the combined depth of said first female socket and said depth second male socket, and the combined height of said first female collar and second male collar.

5. The floating module of claim 4 further comprising a second floating module, wherein said first end wall of said second floating module abuts said second end wall of said floating module, wherein said first male interconnecting assembly is in axial alignment with said second female interconnecting assembly of said floating module and said first female interconnecting assembly of said second floating module is in axial alignment with said second male interconnecting assembly of said floating module.

6. The floating module of claim 5 further comprising:

a first cable extending from said first end wall of said floating module, through said aperture in said base plate of said first male interconnecting assembly through said first conduit, through said aperture in said base plate of said second female interconnecting assembly, through said bore in said first resilient member, through said aperture in said base plate of said first male interconnecting assembly of said second floating module through said first conduit in said second floating module, and through said aperture of said second female interconnecting assembly of said second floating module, a second cable extending from said first end wall of said floating module, through said aperture in said base plate of said first female interconnecting assembly through said second conduit, through said aperture in said base plate of said second male interconnecting assembly, through said bore in said second resilient member, through said aperture in said base plate of said first female interconnecting assembly of said second floating module through said second conduit in said second floating module, and through said aperture of said second male interconnecting assembly of said second floating module, wherein said first cable has a first end fastened to said first end wall of said floating module and a second end secured to said second end wall of said second floating module, wherein said second cable has a first end secured to said first end wall of said floating module and a second end secured to said second end wall of said second floating module, and wherein said first cable and said second cable are secured under tension to compress said first and second resilient members.

7. The floating module of claim 6 further comprising a plurality of floating modules connected second end wall to first end wall to form a floating structure.

8. The floating module of claim 5 further comprising a third conduit extending transversely through said shell from a first aperture in said first side to a first aperture in said second side of said shell, and a fourth conduit extending transversely through said shell from a second aperture in said first side to a second aperture in said second side of said shell.

9. The floating module of claim 8 further comprising:

a first cable extending from said first end wall of said floating module, through said aperture in said base plate of said first male interconnecting assembly, through said first conduit, through said aperture in said base plate of said second female interconnecting assembly, through said bore in said first resilient member, through said first aperture in said first side of said second floating assembly, through said third conduit and out said first aperture in said second side of said second floating module, and a second cable extending from said first end wall of said floating module, through said aperture in said base plate of said first female interconnecting assembly, through said second conduit, through said aperture in said base plate of said second male interconnecting assembly, through said bore in said second resilient member, through said second aperture in said first side of said second floating assembly, through said fourth conduit and out said second aperture in said second side of said second floating module.

* * * * *